US007949098B2

(12) United States Patent
Ellinwood et al.

(10) Patent No.: US 7,949,098 B2
(45) Date of Patent: May 24, 2011

(54) METHOD FOR DETERMINING REDUCED EXPOSURE CONDITIONS FOR MEDICAL IMAGES

(75) Inventors: Jacquelyn S. Ellinwood, Rochester, NY (US); Karin Topfer, Rochester, NY (US); Steven Don, St. Louis, MO (US); Bruce R. Whiting, St. Louis, MO (US)

(73) Assignee: Carestream Health, Inc., Rochester, NY (US)

( * ) Notice: Subject to any disclaimer, the term of this patent is extended or adjusted under 35 U.S.C. 154(b) by 32 days.

(21) Appl. No.: 12/470,895

(22) Filed: May 22, 2009

(65) Prior Publication Data

US 2010/0091950 A1 Apr. 15, 2010

Related U.S. Application Data

(60) Provisional application No. 61/104,330, filed on Oct. 10, 2008.

(51) Int. Cl.
*H05G 1/42* (2006.01)

(52) U.S. Cl. ..... 378/108; 378/62

(58) Field of Classification Search ..... 378/198–112, 378/62, 98, 97; 382/132
See application file for complete search history.

(56) References Cited

U.S. PATENT DOCUMENTS 5,396,531 A 3/1995 Hartley
7,280,635 B2 10/2007 Toth
7,298,823 B2 * 11/2007 Bernhardt et al. ..... 378/97
7,480,365 B1 1/2009 Topfer et al.
2006/0002513 A1 * 1/2006 Bernhardt et al. ..... 378/97

OTHER PUBLICATIONS

Steven Don, et al., "Preliminary validation of a new methodology for estimating dose reduction protocols in neonatal chest computed radiographs," Medical Imaging 2006: Physics of Medical Imaging, SPIE Medical Conference.

Steve Don, et al., "Observer Performance in the Detection of Neonatal Pneumothorax: Use of a Stochastic Noise Generator to Simulate Reduced-Dose Computed Radiography," 2006 RSNA Technical Exhibit, The 92nd Scientific Assemby and Annual Meeting of the Radiological Society of North America.

* cited by examiner

*Primary Examiner* — Hoon Song

(57) ABSTRACT

A method of obtaining recommendations for lowered radiation dose for a type of radiological image, executed at least in part by a computer system, obtains at least one clinical image of at least one patient, taken under a baseline set of exposure conditions, as a basis image. Processing instructions related to image simulation under one or more reduced exposure conditions are obtained. The basis image is processed according to the processing instructions to generate a set of one or more simulation images, each simulation image representative of corresponding reduced exposure conditions. One or more simulation images are displayed to one or more diagnostic practitioners and an evaluation obtained from the one or more practitioners related to at least the quality of the one or more simulation images. At least one recommended reduced exposure condition is generated and electronically stored according to the practitioner evaluation.

17 Claims, 15 Drawing Sheets

62

*Experimental Design*

*Goal:* *Define an exposure recommendation range for NICU patients weighing less than 4 pounds that Have been diagnosed with pneumothorax*

*Images:* *60 images of 40 NICU patients weighing under 4 lbs at the time of examination*

*Fixed variables: Site A, 60kVp, 2mAs, 40" SID, diagnosis of pneumothorax*

*Simulated dose reductions:* *from 2.0 mAs to 0.2 mAs in 0.05 increments (37 levels)*

*Radiologists:* *5 radiologists, Pediatric specialists*

*Optimization Method:* *Response Surface Analysis, Mean with 95% Confidence Intervals, Minimum Acceptable Rating Threshold: -2.0*

FIG. 5B

64

Mean Quality Ratings
Each Bin Represents 50 Ratings
(10 image simulations, 5 Radiologist Ratings)

| | Patient Weight (lbs) at time of examination | | | | | |
|---|---|---|---|---|---|---|
| mAs | 0-1.50 | 1.51-2.00 | 2.01-2.50 | 2.51-3.00 | 3.01-3.50 | 3.51-4.00 |
| 0.2 | -4 | -4 | -4 | -4 | -4 | -4 |
| 0.25 | -4 | -4 | -4 | -4 | -4 | -4 |
| 0.3 | -4 | -4 | -4 | -4 | -4 | -4 |
| 0.35 | -4 | -4 | -4 | -4 | -4 | -4 |
| 0.4 | -4 | -4 | -4 | -4 | -4 | -4 |
| 0.45 | -3.98 | -4 | -4 | -4 | -4 | -4 |
| 0.5 | -3.9 | -4 | -4 | -4 | -4 | -4 |
| 0.55 | -3.9 | -3.9 | -4 | -4 | -4 | -4 |
| 0.6 | -3.8 | -3.9 | -4 | -4 | -4 | -4 |
| 0.65 | -3.7 | -3.8 | -4 | -4 | -4 | -4 |
| 0.7 | -3.6 | -3.7 | -3.8 | -4 | -4 | -4 |
| 0.75 | -3.6 | -3.6 | -3.7 | -4 | -4 | -4 |
| 0.8 | -3.2 | -3.3 | -3.4 | -3.7 | -4 | -4 |
| 0.85 | -2.96 | -3 | -3.24 | -3.64 | -3.9 | -4 |
| 0.9 | -2.7 | -3 | -3.2 | -3.5 | -3.7 | -3.8 |
| 0.95 | -2.4 | -2.7 | -3.1 | -3.1 | -3.5 | -3.6 |
| 1 | -2.2 | -2.2 | -2.7 | -2.9 | -3.3 | -3.4 |
| 1.05 | -1.96 | -2.04 | -2.3 | -2.6 | -3 | -3.2 |
| 1.1 | -1.8 | -1.9 | -2.02 | -2.3 | -2.7 | -3 |
| 1.15 | -1.66 | -1.6 | -1.8 | -2.1 | -2.5 | -2.8 |
| 1.2 | -1.5 | -1.44 | -1.7 | -2.02 | -2.3 | -2.6 |
| 1.25 | -1 | -1.2 | -1.6 | -1.9 | -2.02 | -2.4 |
| 1.3 | -0.94 | -0.98 | -1.2 | -1.8 | -1.8 | -2.2 |
| 1.35 | -0.86 | -0.9 | -0.96 | -1.4 | -1.5 | -1.9 |
| 1.4 | -0.8 | -0.76 | -0.8 | -1.1 | -1.1 | -1.6 |
| 1.45 | -0.76 | -0.6 | -0.6 | -0.9 | -1 | -1.2 |
| 1.5 | -0.5 | -0.44 | -0.5 | -0.7 | -0.8 | -0.9 |
| 1.55 | -0.3 | -0.3 | -0.4 | -0.34 | -0.5 | -0.6 |
| 1.6 | -0.14 | -0.16 | -0.3 | -0.2 | -0.3 | -0.4 |
| 1.65 | -0.04 | 0 | -0.26 | -0.14 | -0.2 | -0.2 |
| 1.7 | 0 | 0 | 0 | 0 | 0 | 0 |
| 1.75 | 0 | 0 | 0 | 0 | 0 | 0 |
| 1.8 | 0 | 0 | 0 | 0 | 0 | 0 |
| 1.85 | 0 | 0 | 0 | 0 | 0 | 0 |
| 1.9 | 0 | 0 | 0 | 0 | 0 | 0 |
| 1.95 | 0 | 0 | 0 | 0 | 0 | 0 |
| 2 | 0 | 0 | 0 | 0 | 0 | 0 |

Standard Deviation Quality Ratings
Each Bin Represents 50 Ratings
(10 image simulations, 5 Radiologist Ratings)

| | Patient Weight (lbs) at time of examination | | | | | |
|---|---|---|---|---|---|---|
| mAs | 0-1.50 | 1.51-2.00 | 2.01-2.50 | 2.51-3.00 | 3.01-3.50 | 3.51-4.00 |
| 0.2 | 0.00 | 0.00 | 0.00 | 0.00 | 0.00 | 0.00 |
| 0.25 | 0.00 | 0.00 | 0.00 | 0.00 | 0.00 | 0.00 |
| 0.3 | 0.00 | 0.00 | 0.00 | 0.00 | 0.00 | 0.00 |
| 0.35 | 0.00 | 0.00 | 0.00 | 0.00 | 0.00 | 0.00 |
| 0.4 | 0.00 | 0.00 | 0.00 | 0.00 | 0.00 | 0.00 |
| 0.45 | 0.14 | 0.00 | 0.00 | 0.00 | 0.00 | 0.00 |
| 0.5 | 0.30 | 0.00 | 0.00 | 0.00 | 0.00 | 0.00 |
| 0.55 | 0.30 | 0.30 | 0.00 | 0.00 | 0.00 | 0.00 |
| 0.6 | 0.45 | 0.30 | 0.00 | 0.00 | 0.00 | 0.00 |
| 0.65 | 0.54 | 0.39 | 0.00 | 0.00 | 0.00 | 0.00 |
| 0.7 | 0.64 | 0.54 | 0.45 | 0.00 | 0.00 | 0.00 |
| 0.75 | 0.64 | 0.63 | 0.57 | 0.00 | 0.00 | 0.00 |
| 0.8 | 0.78 | 0.74 | 0.67 | 0.46 | 0.00 | 0.00 |
| 0.85 | 0.28 | 0.35 | 0.62 | 0.48 | 0.27 | 0.00 |
| 0.9 | 0.81 | 0.74 | 0.74 | 0.58 | 0.50 | 0.45 |
| 0.95 | 0.61 | 0.70 | 0.72 | 0.72 | 0.58 | 0.49 |
| 1 | 0.67 | 0.67 | 0.81 | 0.80 | 0.84 | 0.78 |
| 1.05 | 0.60 | 0.59 | 0.73 | 0.78 | 0.64 | 0.70 |
| 1.1 | 0.70 | 0.68 | 0.73 | 0.69 | 0.64 | 0.67 |
| 1.15 | 0.59 | 0.64 | 0.77 | 0.72 | 0.67 | 0.73 |
| 1.2 | 0.65 | 0.70 | 0.84 | 0.99 | 0.79 | 0.63 |
| 1.25 | 0.40 | 0.57 | 0.83 | 0.85 | 0.84 | 0.64 |
| 1.3 | 0.47 | 0.47 | 0.63 | 0.86 | 0.86 | 0.85 |
| 1.35 | 0.61 | 0.60 | 0.62 | 0.57 | 0.54 | 0.67 |
| 1.4 | 0.49 | 0.52 | 0.49 | 0.50 | 0.50 | 0.56 |
| 1.45 | 0.43 | 0.56 | 0.56 | 0.67 | 0.64 | 0.81 |
| 1.5 | 0.58 | 0.54 | 0.54 | 0.57 | 0.52 | 0.63 |
| 1.55 | 0.51 | 0.45 | 0.53 | 0.51 | 0.50 | 0.57 |
| 1.6 | 0.35 | 0.37 | 0.46 | 0.40 | 0.46 | 0.49 |
| 1.65 | 0.20 | 0.00 | 0.44 | 0.35 | 0.40 | 0.40 |
| 1.7 | 0.00 | 0.00 | 0.00 | 0.00 | 0.00 | 0.00 |
| 1.75 | 0.00 | 0.00 | 0.00 | 0.00 | 0.00 | 0.00 |
| 1.8 | 0.00 | 0.00 | 0.00 | 0.00 | 0.00 | 0.00 |
| 1.85 | 0.00 | 0.00 | 0.00 | 0.00 | 0.00 | 0.00 |
| 1.9 | 0.00 | 0.00 | 0.00 | 0.00 | 0.00 | 0.00 |
| 1.95 | 0.00 | 0.00 | 0.00 | 0.00 | 0.00 | 0.00 |
| 2 | 0.00 | 0.00 | 0.00 | 0.00 | 0.00 | 0.00 |

FIG. 5C

66

Rating Scale
0 = no difference from reference
-1 = image quality slightly worse than reference, diagnosis will be the same
-2 = image quality is somewhat worse than reference, diagnosis should the same
-3 = image quality is clearly worse than reference, diagnosis might be altered
-4 = image quality is markedly worse than reference, diagnosis is likely altered

FIG. 5D

68

| | | | | | | |
|---|---|---|---|---|---|---|
| Statistical Results | | | | | | |
| Response Surface Analysis | | | | | | |
| Prediction Equation | | | | | | |
| | mAs = 1.61 + 0.06Weight + 0.30Rating + 0.004(Weight – 2.56)^2 - | | | | | |
| | 0.007*(Weight – 2.56)*(Rating + 2.17) – 0.007(Rating +2.17)^2 | | | | | |
| | | | | | | |
| Predicted mAs for minimum acceptable rating threshold | | | | | | |
| | Weight (lbs) | Minimum exposure (mAs) | | | | |
| | 1.5 | 1.11 | | | | |
| | 2.0 | 1.14 | | | | |
| | 2.5 | 1.16 | | | | |
| | 3.0 | 1.19 | | | | |
| | 3.5 | 1.23 | | | | |
| | 4.0 | 1.26 | | | | |
| | | | | | | |
| Mean and 95% Confidence Interval | | | | | | |
| Minimum Acceptable Rating Based on 95% Confidence | | | | | | |
| Interval for Actual Rating Means | | | | | | |
| | | | | | | |
| | Weight (lbs) | Minimum exposure (mAs) | Mean Rating | Lower CI On Mean Rating | | |
| | 0-1.50 | 1.1 | -1.78 | -1.97 | | |
| | 1.51-2.00 | 1.15 | -1.59 | -1.76 | | |
| | 2.01-2.50 | 1.2 | -1.69 | -1.93 | | |
| | 2.51-3.00 | 1.35 | -1.41 | -1.56 | | |
| | 3.01-3.50 | 1.35 | -1.51 | -1.66 | | |
| | 3.51-4.00 | 1.4 | -1.61 | -1.77 | | |
| | | | | | | |
| Recommendation | | | | | | |
| | Original Exposure | | | | 2.0 mAs | |
| | Recommended Minimum Exposure | | | | 1.4mAs | |
| | Percent reduction | | | | 30% | |

FIG. 5E

METHOD FOR DETERMINING REDUCED EXPOSURE CONDITIONS FOR MEDICAL IMAGES

CROSS REFERENCE TO RELATED APPLICATIONS

Reference is made to, and priority is claimed from, U.S. Ser. No. 61/104,330 filed as a provisional application on 10 Oct. 2008, entitled "Dose-Reduction Decision System For Medical Images" in the names of Jacquelyn S. Ellinwood et al., and commonly assigned.

FIELD OF THE INVENTION

This invention generally relates to diagnostic imaging and more particularly relates to a method for determining a lowered radiation level for a given diagnostic imaging operation.

BACKGROUND OF THE INVENTION

While x-rays have value for diagnosing the condition of a patient, ionizing X-ray radiation is itself harmful to living tissue. In recognition of this hazard, and with the hope of reducing radiation risks wherever possible, numerous organizations of radiation specialists have been developed throughout the world to report on radiation usage, certify radiation specialists, and make recommendations on radiation settings and procedures. These organizations include professional societies such as the Radiological Society of North America (RSNA) and European Society of Radiology (ESR), centers of learning such as American College of Radiology (ACR) and Royal College of Radiologists (RCR), agencies such as International Radiation Protection Association (IRPA) and International Atomic Energy Agency (IAEA), and commissions such as International Commission on Radiation Units and Measurements (ICRU) and National Council on Radiation Protection and Measurement (NCRP).

In the late 1970s, the International Commission on Radiological Protection (ICRP) proposed that a policy of ALARA (As Low As Reasonably Achievable) be adopted for radiological personnel and, more recently, for patients who undergo x-ray imaging. ALARA practice makes every reasonable effort to maintain exposures to ionizing radiation as far below the dose limits as practical. This effort is based on the awareness that any radiation exposure, no matter how small, carries with it a certain level of risk that is proportional to the level of exposure. The concept of ALARA has been adopted or supported by numerous professional organizations, but implementation of ALARA practice varies. Thus, actual exposure levels used for different types of imaging vary from region to region and even from site to site, based on practical factors such as equipment type and condition, user experience, pathology, personal preference, standard practices, regulatory requirements, and cultural influence.

While exposure reduction is a worthwhile goal, its implementation should not compromise the capabilities that radiological imaging systems offer to the diagnostician. Exposure level is itself one of the most influential factors in determining the diagnostic and image quality of a radiographic image. Incorrectly reducing X-ray exposure levels may result in poor quality images with reduced diagnostic value. Images produced with too little exposure can be characterized by problems such as excessive graininess and low contrast. These problems make such images more difficult to use and potentially compromise or imperil proper diagnosis. In some cases, exposure below a threshold level yields an image of inferior quality and limited utility; often, as a result, the patient must be re-imaged at a higher exposure level in order to generate a radiographic image of sufficient quality.

Using ALARA guidelines, manufacturers and users of x-ray equipment have expended considerable effort to develop both acquisition settings and procedural techniques that help to reduce exposure levels. For example, technique charts that provide recommended exposure settings for various conditions could be developed to meet the ALARA objective. These reduced settings may then be used for system tools that help to control dose levels, such as automatic exposure control (AEC) and anatomical programmed radiography (APR). Additionally, manufacturers and users of x-ray equipment have supported the ALARA concept by co-optimizing some or all of the imaging events such as image capture, image rendering, and image presentation.

There are times when current practices developed to support ALARA may need to be adjusted. Adjustment may be needed, for example, at introduction of a new source or detector technology, as a result of changed characteristics of the patient population such as patient age and size, with new support tools such as computer aided detection and computer aided diagnosis, and as a result of changing administrative, regulatory, or user strategy. Given an opportunity to view and assess displayed images representative of different exposure levels, the radiologist can then determine whether or not a lower dose image would be acceptable under various conditions. Implementation of such tools can help to reduce patient risk, without compromising image characteristics that relate to accurate diagnosis.

Different approaches to the problem of dose reduction have been proposed. For example, U.S. Pat. No. 7,280,635 entitled "Processes and Apparatus for Managing Low kVp Selection and Dose Reduction and Providing Increased Contrast Enhancement in Non-Destructive Imaging" to Toth describes an approach to defining a reduced dosage level for an imaging system based on an iterative method of obtaining actual image captures while changing driver parameters (e.g., kVp, mA, time). However, this approach requires numerous exposures of the test subject in order to gain an understanding of the preferred exposure level and would not, therefore, be desirable for anything other than real-time imaging such as fluoroscopy.

Another example, given in U.S. Pat. No. 5,396,531 entitled "Method of Achieving Reduced Dose X-Ray Fluoroscopy by Employing Statistical Estimation of Poisson Noise" to Hartley, describes a method for defining acquisition settings that optimize image quality while minimizing radiation dosage to the subject. The '531 patent addresses fluoroscopic imaging applications in which the diagnostician obtains real-time patient images using a fluoroscope. While low dose levels are typically used during fluoroscopy procedures, however, the length of a typical procedure often results in a relatively high exposure level to the patient. As with the Toth '635 disclosure, this approach requires multiple exposures of the patient in order to establish the preferred exposure level.

Simulation has been proposed as an alternate strategy for providing tools for defining or re-defining exposure levels that minimize patient exposure without compromising diagnostic image quality. In reduced-dose image simulation, an image that has already been acquired under a set of known, controlled conditions is used a basis image. From this basis, it is then possible to digitally generate new versions of the image as it would appear if it were acquired under various lower-dose conditions, without actually obtaining these additional acquisitions. Advantages of simulation over other approaches include: generation of an image without additional exposure to the patient, exploration of a range of exposure levels without risk of compromised diagnosis, obtaining images with identical positioning of the patient yet differing only in noise content, and evaluation of numerous patient types and pathologies.

There are a number of factors that affect exposure level in radiographic imaging, including the following: 1) energy distribution (keV) of the x-ray beam described by the maximum energy or accelerating voltage in kilovolts peak (kVp) and beam filtration; 2) tube current measured in milliamps (mA); 3) exposure time measured in seconds or fractions of a second; and 4) source to image distance (SID) measured in inches.

However, not all of these factors lend themselves to image simulation. Accelerating voltage is one example. Different anatomical structures such as bone, muscle, or fat, attenuate x-ray radiation in differing amounts as a function of the incident x-ray energy, keV. Over one range of energy levels specified by one accelerating voltage value, the attenuation of different types of tissue may vary significantly, while over another range specified by a different accelerating voltage value, very little attenuation difference may be perceived. Where the difference in attenuation is sufficient, incident radiation with proper intensity can generate an exposure at the imaging detector that allows differentiation between various anatomical components and, as a result, allows a radiologist to properly diagnose injury or illness from a radiographic image. Where the difference in attenuation is not sufficient, incident radiation may generate an exposure with little or no differentiation between anatomical components and the resulting image may be inadequate for the desired diagnosis. In a clinical setting, the accelerating voltage, and thus the energy distribution and, indirectly, radiation intensity, is chosen to maximize attenuation differences between the anatomical structures used in diagnosis. It is difficult to simulate a radiograph with a reduced exposure level due to modified accelerating voltage as it may require compensation of attenuation differences in anatomical components that were not discernible in the basis image. There is no way to accurately compensate for data that was never captured on the radiation-sensitive imaging plate that would have been present if a different accelerating voltage were used.

Other factors that do not readily lend themselves to simulation include patient positioning and x-ray source geometry. For instance, the radiation level depends on the distance from source to patient, but this also influences magnification and image sharpness in a complex fashion, which cannot be simulated from a two-dimensional projection measurement.

Other exposure factors, however, can be readily simulated, in particular the combination of tube current and exposure time. For instance, exposure time affects the amount of signal and noise levels in the image, conventionally expressed as the signal-to-noise ratio. By accurate modeling of the characteristic noise level as it changes with exposure time, it is possible to give the diagnostician some useful tools for determining the appropriate exposure time and thus potentially define new acquisition settings and procedural techniques related to exposure time that result in reduced radiation dose levels. Likewise, the magnitude of the x-ray tube current influences signal and noise in a linear manner, so that decreases in tube current for a fixed exposure time would decrease the signal-to-noise ratio in an computable manner. Thus, unlike accelerating voltage or patient positioning, exposure time and tube current are exposure factors that lend themselves to image simulation.

Numerous methods for generating low-dose radiographic images are provided in the literature. One example is disclosed in commonly assigned U.S. Pat. No. 7,480,365 entitled "Dose-Reduced Digital Medical Image Simulations" to Töpfer et al. Simulations carried out in this manner can be highly accurate. Other promising study results using images from cadavers were presented in a paper at the 2006 SPIE Medical Conference entitled "Preliminary Validation of a New Methodology for Estimating Dose Reduction Protocols in Neonatal Chest Computed Radiographs", and in a 2006 RSNA Technical Exhibit entitled "Observer Performance in the Detection of Neonatal Pneumothorax: Use of a Stochastic Noise Generator to Simulate Reduced-Dose Computed Radiography" both by Steven Don, MD, et al.

While there are a number of proven simulation methods, at varying levels of maturity, however, there is a lack of tools for their systematic application. Characteristically, the task of planning and implementing a study for facilitating dose reduction decisions has been a daunting one, in terms of time, cost, and other factors, and efforts expended for this purpose have thus been narrowly limited to very specific types of images taken under a very limited range of conditions. Thus, it can be appreciated that there is a need for a utility that can help the diagnostician to systematically simulate and assess various imaging conditions in order to make accurate decisions for specifying appropriate dose levels for different types of radiographic images.

SUMMARY OF THE INVENTION

It is an object of the present invention to advance the art of radiography and to provide a tool that helps to assess the effects of reduced dose exposure in order to conform more closely to ALARA guidelines without compromising image diagnostic quality. With this object in mind, the present invention provides a method of obtaining recommendations for lowered radiation dose for a type of radiological image, the method executed at least in part by a computer system and comprising: obtaining digital image data for at least one clinical image of at least one patient, taken under a baseline set of exposure conditions, as a basis image; obtaining processing instructions related to image simulation under one or more reduced exposure conditions; processing the basis image according to the processing instructions to generate a set of one or more simulation images, each simulation image representative of corresponding reduced exposure conditions; displaying the one or more simulation images to one or more diagnostic practitioners and obtaining and electronically storing an evaluation from the one or more practitioners related to at least the quality of the one or more simulation images; and generating and electronically storing at least one recommended reduced exposure condition for the type of radiological image according to the practitioner evaluation.

It is a feature of the present invention that it uses simulation under one or more sets of controlled conditions in order to represent the appearance of a diagnostic image at different exposure conditions.

It is an advantage of the present invention that it provides a method for assessing the impact of reducing x-ray exposure levels without additional exposure to a patient by using simulation processing, thus enabling diagnostic professionals to judge whether or not a lower exposure level can be effectively used.

These and other objects, features, and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

While the specification concludes with claims particularly pointing out and distinctly claiming the subject matter of the present invention, it is believed that the invention will be better understood from the following description when taken in conjunction with the accompanying drawings.

FIGS. 5B, 5C, 5D, 5E, and 5F show various types of textual, tabular, and plot output fields for providing data in an output report in one embodiment.

DETAILED DESCRIPTION OF THE INVENTION

Figure 1A:
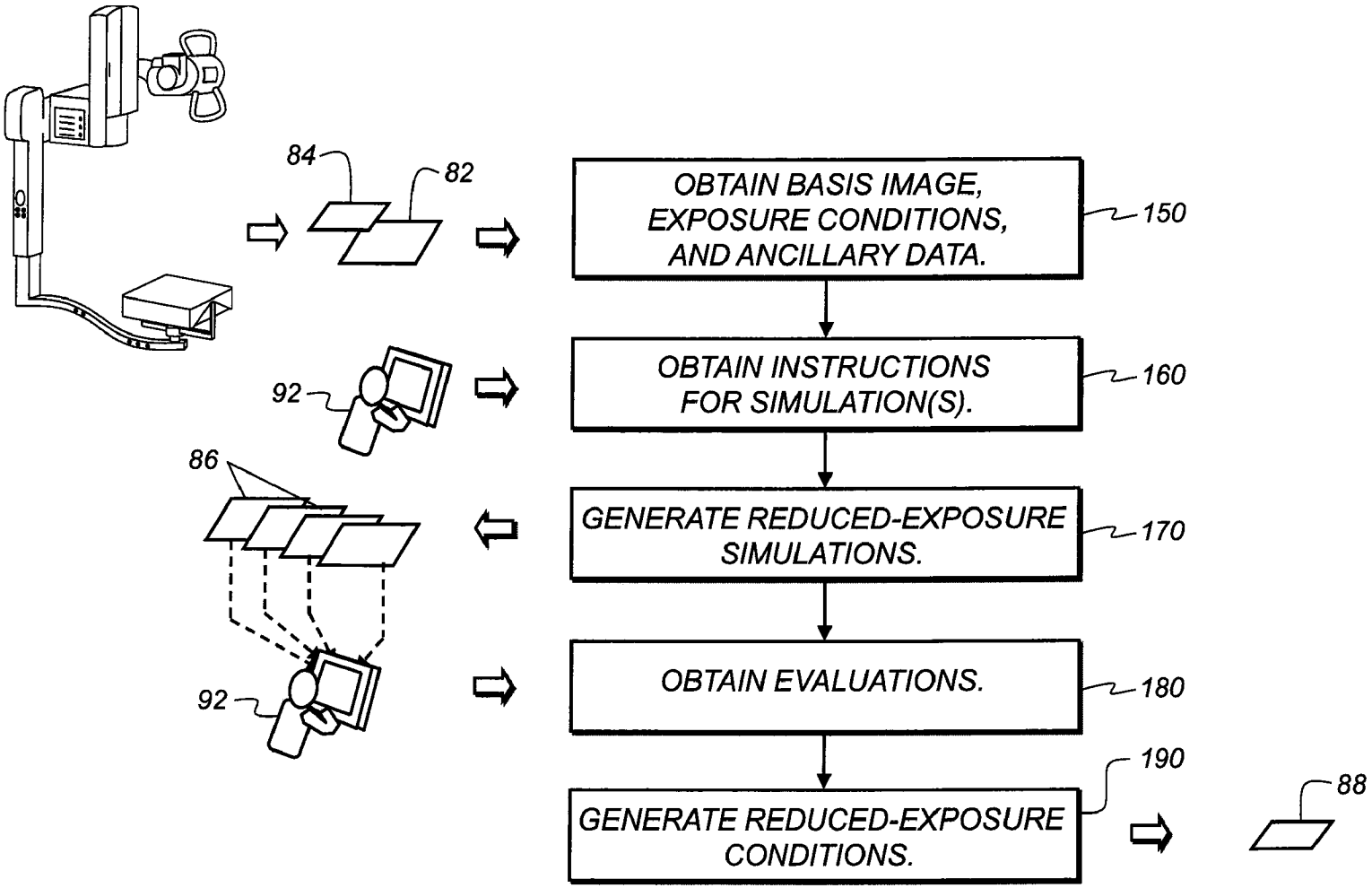
FIG. 1A shows the processing steps used for lower-dose decisions in one embodiment of the present invention.

The present description is directed in particular to elements forming part of, or cooperating more directly with, apparatus in accordance with the invention. It is to be understood that elements not specifically shown or described may take various forms well known to those skilled in the art.

The method of the present invention is executed, at least in part, by a computer or similar logic control processor that executes programmed instructions. The computer may include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice the method according to the present invention.

Embodiments of the present invention provide a method and apparatus that allow systematic simulation and assessment of radiographic imaging conditions for obtaining various types of diagnostic images. Using an embodiment of the present invention, a diagnostician has improved capability for making more accurate decisions when specifying dose levels that are appropriate for different types of radiographic images. The dose levels that are specified using this tool can then be routinely applied in the day-to-day workflow of a diagnostic imaging facility, allowing more consistent application of ALARA guidelines by technologists and other diagnostic practitioners and thus helping to reduce, wherever possible, the overall dose that is applied to patients in order to obtain various types of images. Advantageously, the apparatus and methods of the present invention are adaptable to factors such as regulatory requirements; regional and site preferences; equipment type, age, and condition; user experience; pathology and patient characteristics; diagnostician preferences; standard practices; and cultural influence. Methods and apparatus of the present invention may be used within an individual imaging facility, but may also be used by manufacturers and users of x-ray equipment to develop more effective technique charts and to provide more accurate Automatic Exposure Control (AEC) thresholds and Anatomically Programmed Radiography (APR) settings than those that have been available with earlier methods. Embodiments of the present invention may also serve manufacturers and integrators of x-ray equipment to co-optimize or fine-tune equipment operation for image capture, image rendering, and image presentation.

Embodiments of the present invention operate by the systematic use of simulations. The simulations that are used are based on one or more clinically captured "basis" images, rather than on phantom devices or other targets and as an alternative to using test sequences of multiple patient exposures. Image processing, applied to the basis image as specified by the diagnostic practitioner, simulates the effects of one or more varying radiation dose levels on the basis image for visual assessment.

FIG. 1A shows the operational flow for the method of the present invention in one embodiment and illustrates the role of embodiments of the present invention in the overall diagnostic imaging workflow. In addition, FIG. 1A also shows the role of the human evaluator, diagnostic practitioner 92, typically a radiologist or other qualified medical clinician, in this process for determining a reduced dose level for diagnostic images. An initial obtain basis image step 150 obtains digital data for a basis image 82, its associated exposure conditions and ancillary data 84. Basis image 82 is a clinical image of a patient. Basis image 82 is selected as a suitable image for simulation. In order to be suitable for simulation, basis image 82 itself must have at least some minimal quality level. In addition, basis image 82 is selected to be a representative image of a certain class of images, such as adult skull lateral x-ray, pediatric chest anterior-posterior (AP) chest x-ray, extremity (hand or foot) AP x-ray, or other type of image. Exposure conditions 84 include settings used for mAs, kVp, SID, and any other suitable exposure-related variables that might be varied in order to simulate reduced exposure for any particular type of image. Ancillary data 84 may include patient demographics; purpose of the exam; exam date; patient history, such as information about any diagnosed medical condition of the patient, previous exam results, weight, or age; and any other information that supports the dose decision.

An operator input step 160 obtains instructions from the viewing practitioner 92 for simulation using basis image 82. In general, when simulating reduced mAs, simulation processing modifies the image data content so that the image appears as if it were obtained at some other exposure level, such as at a reduced exposure level, and may include adding noise to degrade the image data content. Noise content could be added in any of a number of ways, in order to determine whether or not the resultant image could be used successfully in diagnosis. The viewing diagnostic practitioner 92 can specify, for example, adding a particular type of noise or specific noise characteristics used for lower-dose simulation.

Still referring to FIG. 1A, generation of reduced-exposure simulations 86 is then carried out by the computer system or processor that executes the simulation process. In one embodiment, the methods disclosed in commonly assigned U.S. Pat. No. 7,480,365 entitled "Dose-Reduced Digital Medical Image Simulations" to Töpfer et al. are applied for obtaining the appropriate simulations. The image is optionally rendered with image enhancement algorithms such as frequency processing, noise reduction, and tonal optimization for enhanced viewing. This operation is performed in a simulations generation step 170. An evaluations step 180 follows, in which practitioner 92 examines one or more of the simulations 86 to determine acceptable exposure levels. Practitioner 92 evaluations are then stored, optionally processed, and used to provide a revised set of output exposure conditions 88 that are suitable for the type of image that serves as basis image 82. A recommendations generation step 190 provides output exposure conditions 88 that can then be electronically stored and applied to technique charts or used for generating threshold values for AEC or other exposure control devices.

The different steps in the process shown with respect to FIG. 1A may use varying amounts of computer processing as well as operator decision-making and, in some embodiments, computer-assisted decision-making. One benefit of the present invention is that it helps to systematize the decision-making process for achieving lower exposures, using practitioner time in an efficient manner and providing a convenient vehicle for obtaining both automated simulations from an image processing system and subjective judgments from one or more human operators. In general, selection of basis image 82 in obtain basis image step 150 is carried out as a result of practitioner guidance and inspection; however, some embodiments automate this selection process and use computational measures of image quality. Operator input step 160 involves an operator-interface interaction, so that instructions for simulation of the desired types and level can be entered. Generation of simulations in step 170 is then automatically executed based on this input. Obtaining operator evaluations in step 180 again requires operator-interface interaction. In addition, as is shown in subsequent examples, tracking and compiling information from multiple practitioners 92 can be part of the task of evaluations step 180. Generation of reduced-exposure conditions in step 190 can be automated or may rely heavily on decision-making and entry by practitioner 92. In one embodiment, ratings obtained from two or more practitioners 92 are combined, such as by averaging, for example, in order to provide reduced-exposure results.

Overall Logic Flow

Figure 1B:
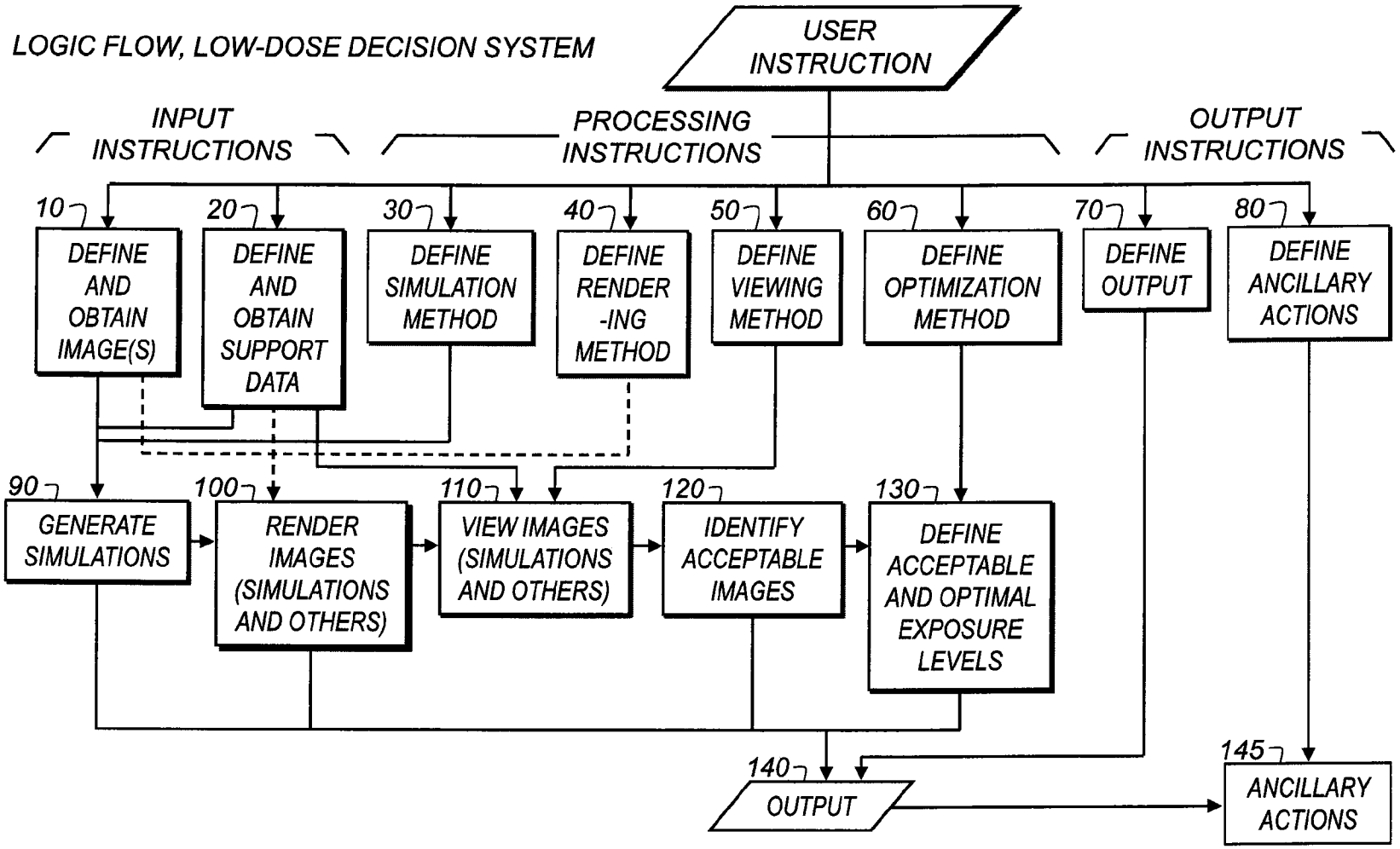
FIG. 1B shows the logic flow that is used to implement lowered-dose decisions and the relationship of this processing to the user input.

As was described with respect to FIG. 1A, one aspect of the present invention relates to the user interface and to system response for obtaining and operating upon the basis image in response to practitioner requirements. FIG. 1B shows exemplary logic flow for the system of the present invention in one embodiment. The process begins with user instructions input that can include a definition of criteria such as the following:

1) the basis images or image selection criteria, specified in a definition step 10;

2) supporting data needed for obtaining a suitable simulation image in a support data entry step 20;

3) simulation method, specified in a simulation method definition step 30;

4) rendering method to be applied, selected using a rendering method specification step 40;

5) viewing method, given in a viewing method selection step 50;

6) optimization method, specified in an optimization method selection step 60;

7) output requirements, given in an output definitions step 70; and, 8) ancillary actions to be taken, defined in an ancillary actions specifications step 80.

FIG. 1B shows that the user instructions can be generally grouped as input instructions, processing instructions, and output instructions. Each group is described in more detail subsequently. As a brief overview of the logic processing shown in FIG. 1B, the simulations themselves are generated in a generation step 90 based on the image definition, support data definition, and simulation method definition, and all images are subsequently subjected to a rendering step 100 according to the rendering definition and support data. In a display step 110, images and image simulations are viewed according to the viewing definition. Support data may also be available to the viewer. The acceptability of the images is defined by the practitioner, such as a radiologist or other clinician, in an acceptability acknowledgement step 120. Once a sufficient number of images of a particular kind have been evaluated, the acceptable and optimal exposure levels are defined in a conclusion step 130 according to the optimization method definition. Output 140 may include image simulations, rendered images, definition of acceptable images, or definition of acceptable and optimal exposure levels and is generated according to the output definition. In one embodiment, recommended reduced exposure conditions as output are directed to a digital file for retrieval, indexed according to one or more of exposure conditions, purpose of the exam, patient demographics, exam date, and patient history. Ancillary actions 145 may be initiated, such as additional image retrieval and archiving, and are performed according to the ancillary action definition.

Figure 2A:
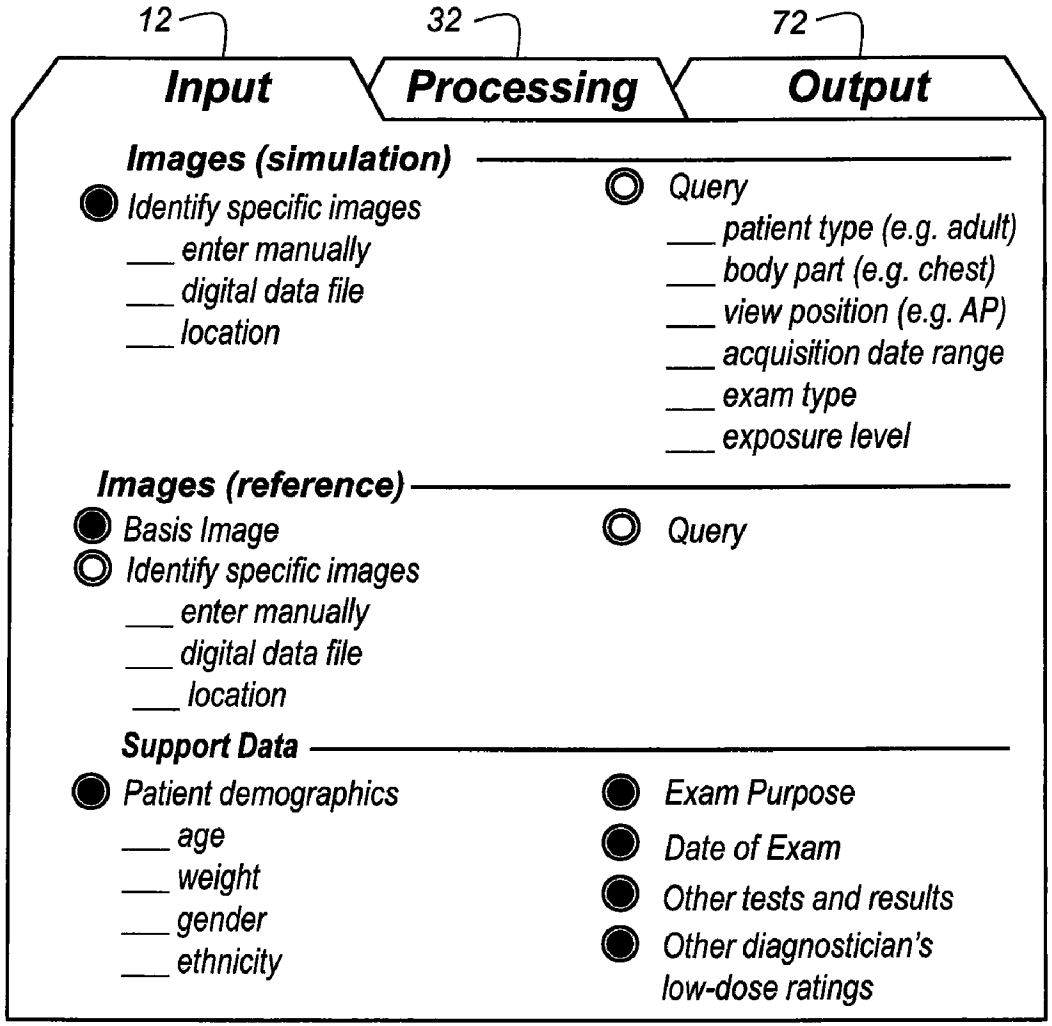
FIG. 2A shows a graphical user interface for entry of input instructions in one embodiment.
Figure 2B:
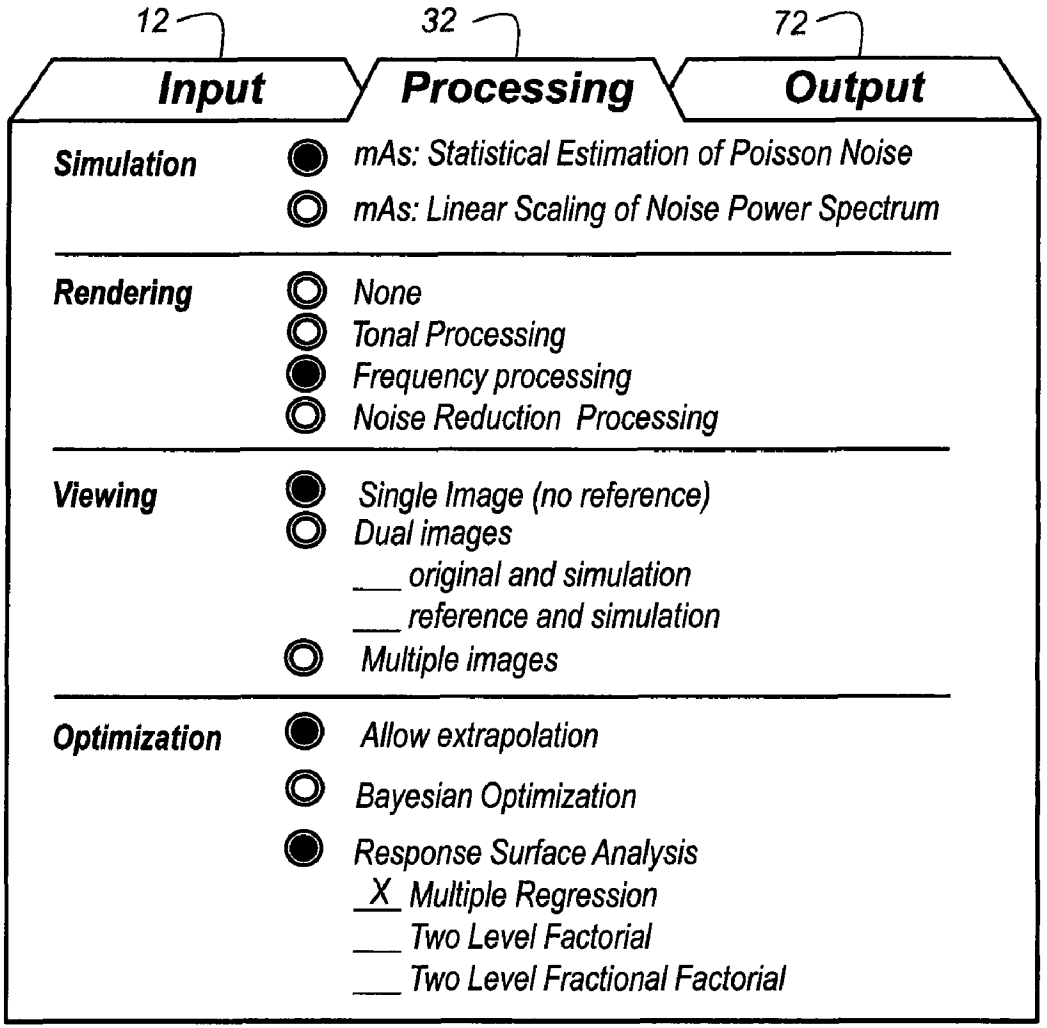
FIG. 2B shows a graphical user interface for entry of processing instructions in one embodiment.
Figure 2C:
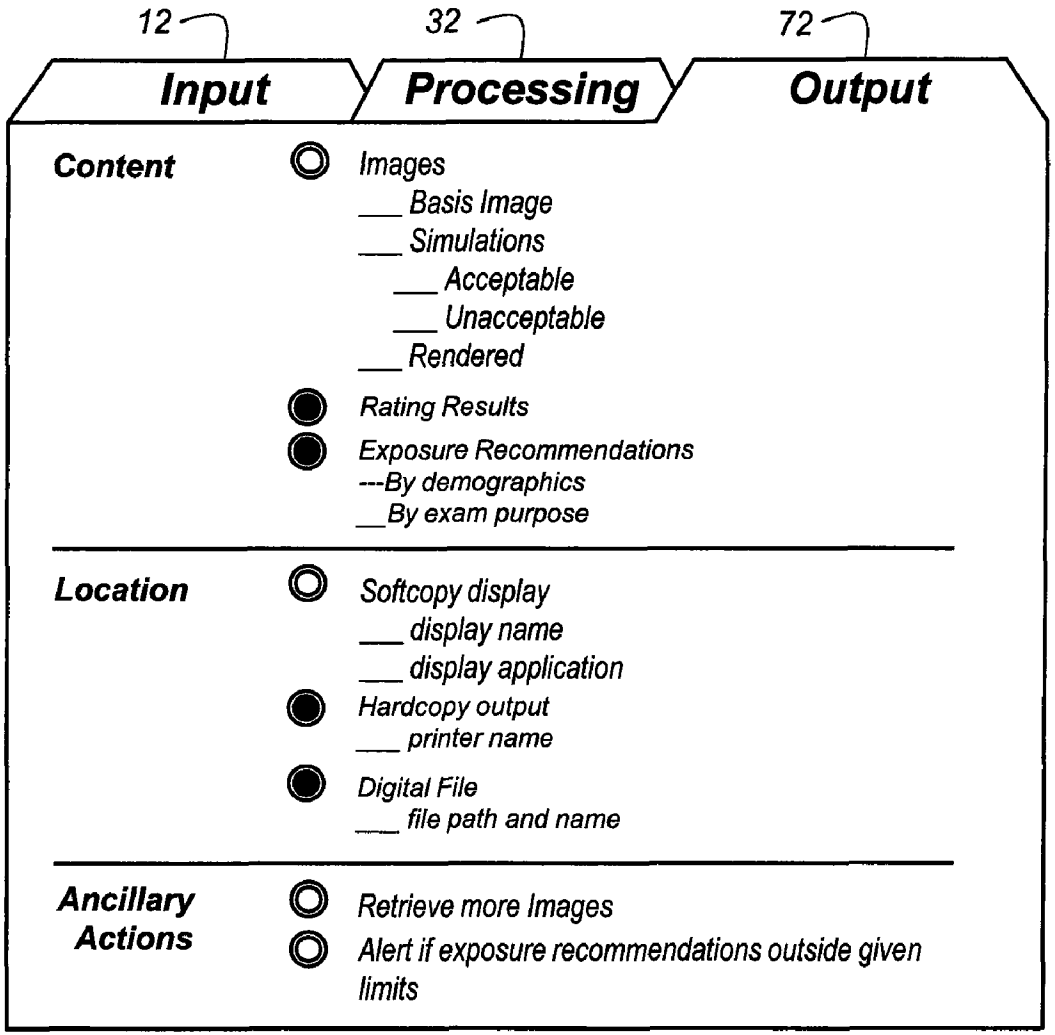
FIG. 2C shows a graphical user interface for entry of output instructions in one embodiment.

As noted, User Instructions are generally grouped as input instructions, processing instructions, and output instructions. FIGS. 2A through 2C illustrate components of the User Instruction input and show one exemplary embodiment of a graphical user interface (GUI) that is used as part of a graphical user interface on a (softcopy) display monitor. Using the GUI of FIGS. 2A-2C, user selections are entered using familiar methods and tools for operator command entry in computer software applications, such as by clicking on "radio buttons", toggle icons, command buttons, or check boxes, by selecting from pull-down menu listings, or by manipulating other conventional GUI mechanisms.

Referring to the GUI of FIGS. 2A-2C, input instructions are shown under tab 12; processing instructions are shown under tab 32; and output instructions are shown under tab 72.

Input Instructions

Figure 3:
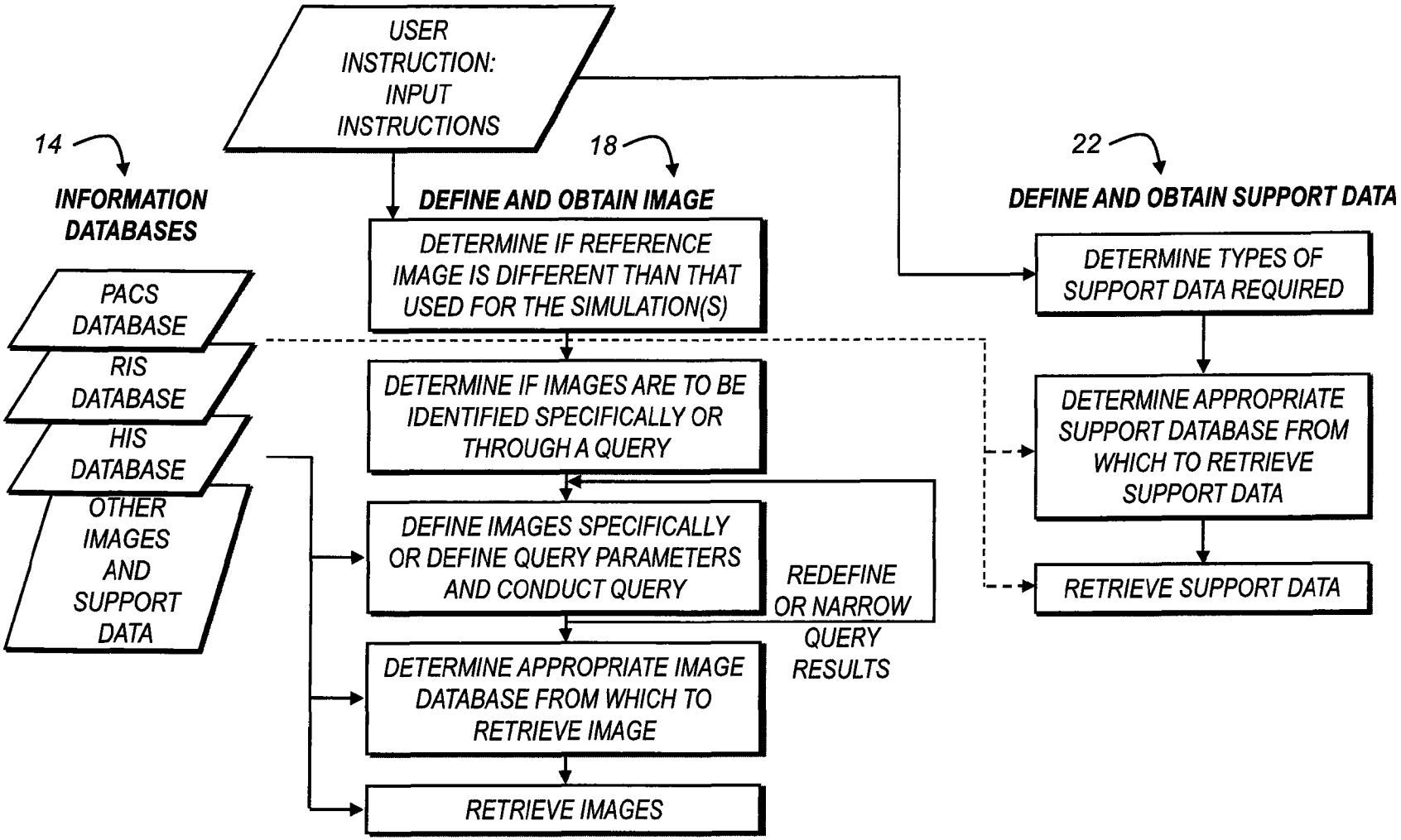
FIG. 3 shows the logic flow for image and support data definition in the Input Instructions of the User Interface.

The input instructions, shown under a tab 12 in the GUI of FIG. 2A, set up how the basis and reference input images are specified and can include instructions for obtaining image and support data. A logic flow for image and support data definition is illustrated in FIG. 3. Images and support data come from information databases 14. Information databases 14 from which image and support data are obtained can be, for example, standard healthcare information storage databases such as picture archive and communication system (PACS) databases, radiology information system (RIS) databases, and hospital information system (HIS) databases, or may be an offline database developed for a specific purpose, for example low-dose imaging. A PACS database stores and manages all images acquired in the radiology department for image diagnosis. These images are stored in Digital Imaging and Communications in Medicine (DICOM) format to facilitate image communication and display. The RIS database provides information about radiology operation including patient registration, examination scheduling, diagnosis report, and other examination information. The HIS database is an integrated information system designed to manage the administrative, financial, and clinical aspects of a hospital. Its database provides thorough information about patient records such as patient medical history, clinical diagnosis, and lab test data.

As shown in the GUI example of FIG. 2A, an image for use as a basis image for simulation may be specifically identified through an interface on the softcopy display, with a filename manually entered, or may be obtained using a digital file, or through a query. A radiologist or other practitioner may have previously identified images of interest, for example, from a particular radiological exam or from a specific patient. If this were the case, the radiologist would need to identify the specific images of interest by name, specifying "enter manually" as an optional selection on the interface displayed under tab 12, for example. Conversely, a radiologist may wish to sample images of a specific type, such as neonatal chest images, for example, or may wish to sample images across a wide range of conditions, such as all images within a certain exposure range or images for patients of a certain type or age. In such a case, instead of specifying a particular image as the basis image for simulation, the radiologist may perform a query of the information databases to identify and extract one or more images of interest, so that each image can be considered for simulation. Images can be obtained and used for simulation as well as for reference. Various support data may also be retrieved, such as information indicating age, sex, or other physical characteristics of a patient. Support data can also include information on the purpose of the exam, on exam conditions, and on related tests, images, and results. Support data may also include a previous diagnostician's low-dose ratings. Once the reference image, image or images to be used for simulation, and desired support data are defined, the image and support data are retrieved for use in subsequent processing.

Referring again to FIG. 3, a number of considerations for defining and obtaining a basis image and one or more reference images are grouped as an image definition step 18. This can include determining whether or not a separate reference image is needed and how the basis and optional reference images are to be specified. Considerations and logic for obtaining a specific file or using a query are shown. Query results may need further processing or improved tuning of a query, for example. The appropriate database for image retrieval must also be specified.

Still referring to FIG. 3, in addition to identification and extraction of the images of interest, the user may identify supporting data that is of interest as part of a support data definition step 22. Supporting data may include factors such as patient demographics, purpose of the exam, date of the exam, other tests and their results, and other diagnostician's ratings for low-dose acceptability. Once the supporting data are defined, the data can be retrieved for use in subsequent steps.

Processing Instructions

The processing instructions, shown under a tab 32 in the GUI of FIG. 2B, provide information such as the type of simulation to perform, the image rendering to apply, how the image is to be viewed, and the method of optimization processing. Numerous methods of simulating low-dose images are known to those skilled in the diagnostic imaging arts, with varying levels of complexity, maturity, utility, and validation. Some existing methods simulate image noise as tube current (mA), exposure time (s), or their combination (mAs) changes. Some examples of simulation methods include statistical estimation of Poisson noise as outlined by Hartley in U.S. Pat. No. 5,396,531 and linear scaling of the noise power spectrum as disclosed by Töpfer et al. in commonly assigned U.S. Pat. No. 7,480,365. The GUI of FIG. 2B allows any of these methods to be selected for subsequent simulation processing of the basis image.

Image rendering, also selected as part of the processing instructions, can have significant implications on the visibility of structures within an image. The amount and type of rendering and parameter settings that are applied to the images prior to viewing are also specified under tab 32 in the example GUI of FIG. 2B. Rendering examples include null, tonal (including window/level), frequency, and noise reduction processing, or some appropriate combination thereof. The option to modify parameter settings and visualize the effect of the change during viewing may be available to the user.

Images generated by simulation may be viewed in one of a number of different configurations, singly or in combination with one or more reference images for comparison. As noted earlier, the GUI of FIG. 2B enables the practitioner to specify viewing parameters. Among possible selections are single-image display with a possible ability to toggle between the simulation and reference images, dual-image display options that allow simultaneous display of a simulation image alongside the same image without simulation or alongside a reference image of the same type, or of target quality, or taken under specific conditions of interest, and multiple-image display where some combination of numerous image simulations and reference images are viewed simultaneously.

Figure 4A:
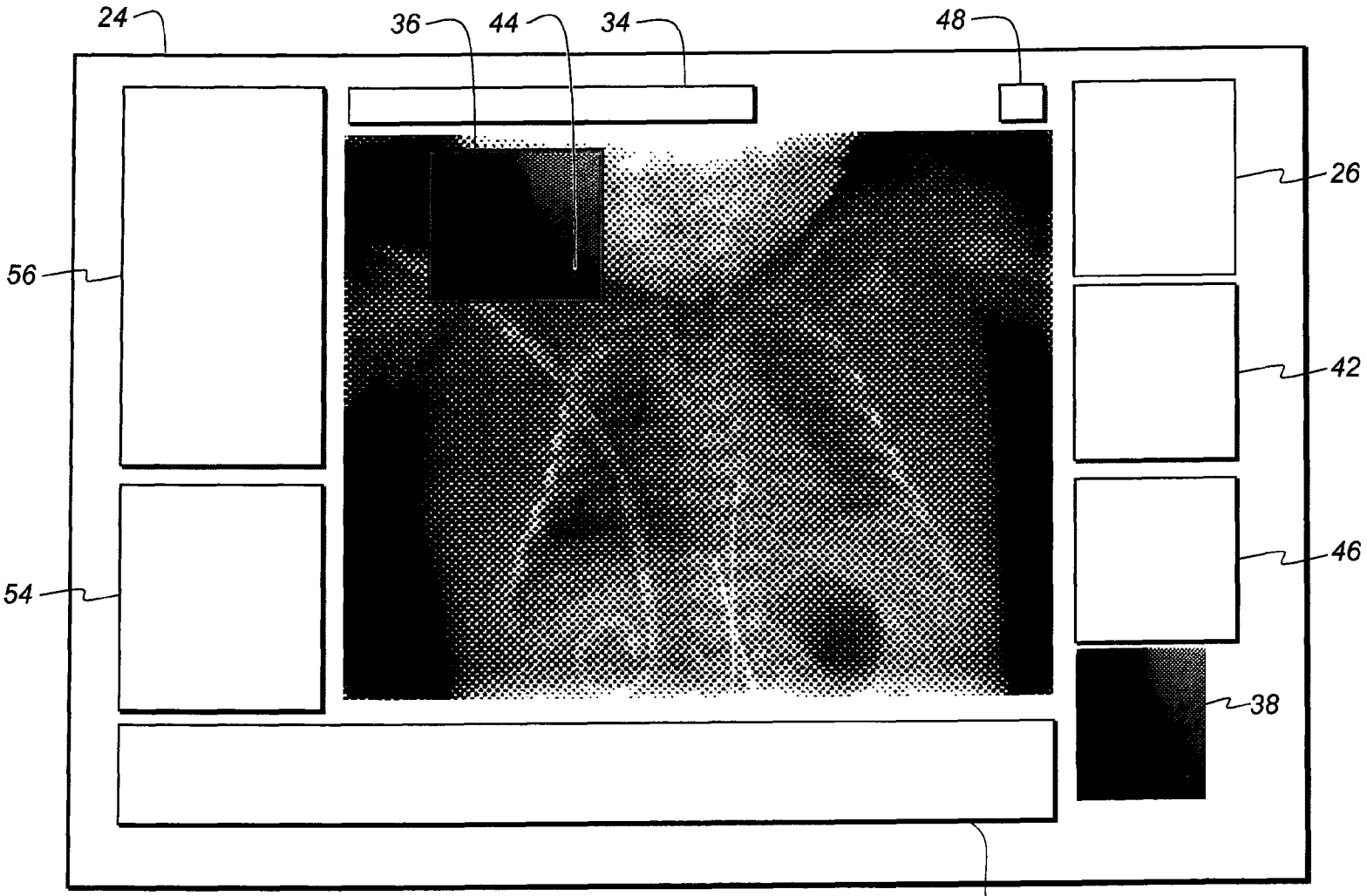
FIGS. 4A, 4B, 4C, and 4D show the arrangement of display contents for basis images, reference images, and simulations in one embodiment of the present invention.
Figure 4B:
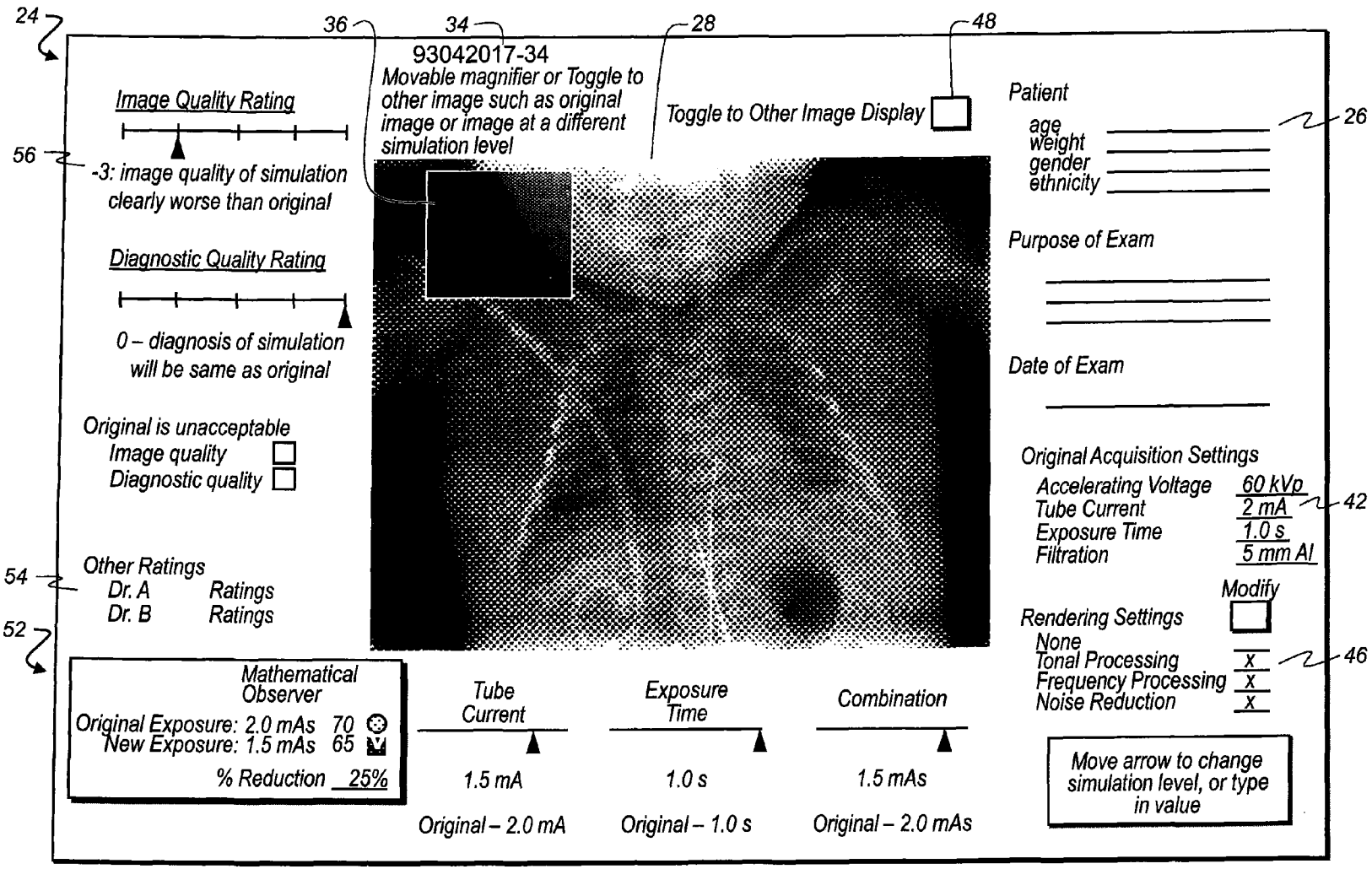
Figure 4C:
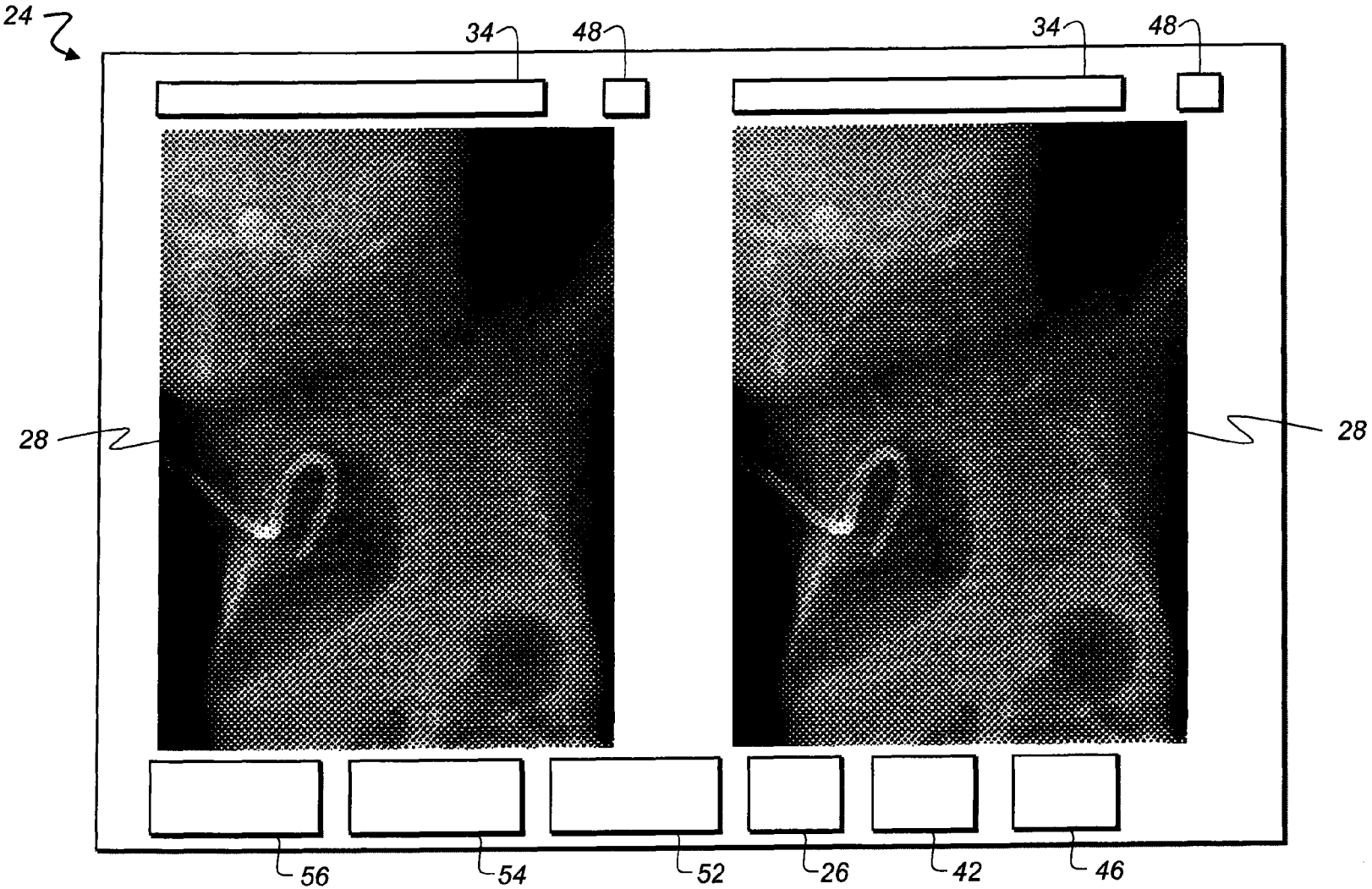
Figure 4D:
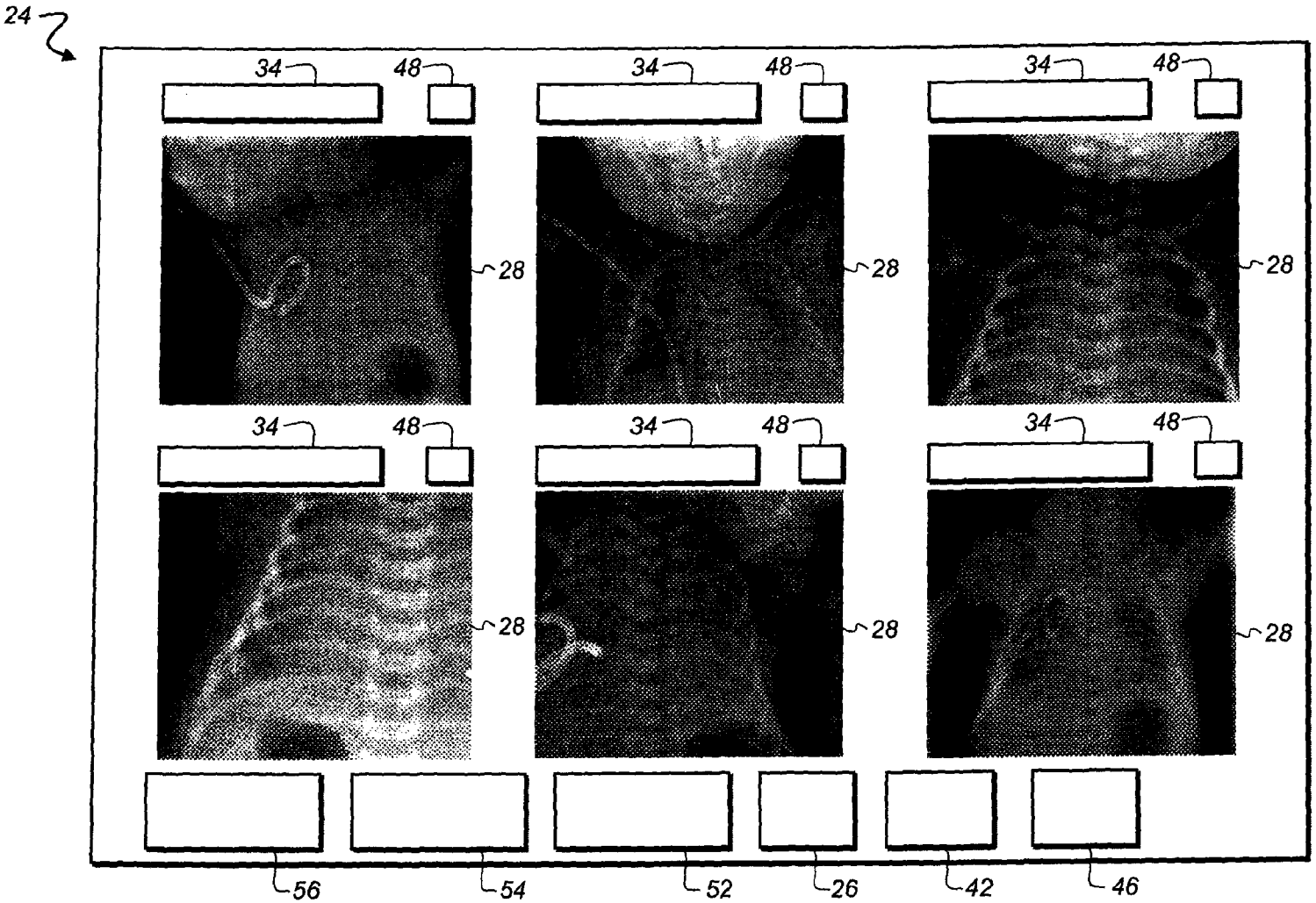

Examples of softcopy visual presentation for image simulation and references are shown in FIGS. 4A-4D. Referring first to FIG. 4A, there is shown the overall arrangement of GUI components that are presented to the viewing practitioner on a display in one embodiment. FIG. 4B then shows an example display for a specific case using the pattern of FIG. 4A. On a display screen 24, one or more data blocks 26 may contain relevant patient data including patient information such as age, weight, gender, and ethnicity, purpose, date, and findings of the imaging exam, and information from other imaging and non-imaging medical tests such as blood laboratory tests, as well as links or other references to that information. An image 28 and an image identifier 34 may be displayed on display screen 24 at some magnification level. Presentation of the image data may include the ability to view an enlarged or positively magnified portion of the image, as shown by windows 36 and 38. The area of interest for magnification may be identified with a cursor 44 and displayed in window 38. Upon user command, the magnification window may replace the window of the original image 28.

The original acquisition settings such as accelerating voltage, tube current, exposure time, and filtration may be displayed for reference in an area 42. The image rendering settings may be displayed in an area 46 and may contain optional controls such as an on-screen slide bar or other control device to adjust levels of rendering such as tonal processing, frequency processing, and noise reduction, for example.

Still referring to FIGS. 4A and 4B, the GUI of display screen 24 provides the ability to toggle among two or more image displays via a toggle button 48 or other control. Toggle button 48 provides the option to switch among image views, such as between the reference image(s) and simulations, to view various simulations of the same image, simulations of various images, or to view various magnifications, with the image being displayed in image window 28 or in smaller windows 36, 38. The toggle may be performed with the images at the originally displayed resolution or with magnified images.

Information about the original and simulated images may be provided in an area 52, as well as the ability to modify the information that would be used to identify the simulated image being displayed, and information about the impact of the modifications. Information may include acquisition settings such as accelerating voltage, tube current, exposure time, combination of tube current and exposure time, estimated absorbed dose, estimated effective dose, percent of dose reduction, estimation of quality based on a modeled mathematical observer, and a visual signal indicating the level of estimated quality. The system user may modify some information, such as tube current, exposure time, or absorbed dose, via a slider bar or entry of a value, which then prompts the system to display an image simulation at that level. Conversely, a system user may toggle through a series of simulations with the information being displayed in the viewer.

Once image assessment is made, the results are entered in an area 56. Prior ratings and associated comments of the same image or image types may also be displayed in an area 54. Image assessment may include image quality ratings, diagnostic quality ratings, paired comparisons, acceptability of the image, and comments. Ratings may be binary, incremental, continuous, independent, or relative to the reference. Ratings may be input for a single simulation or for a range of simulations, for example, at a given exposure level and all lower exposure levels.

Using the GUI of FIG. 4A, a series of simulation sets may be presented in an order identified by the user, for example, in random order, in alphabetical order, or queued in a specific order, such as in order of decreasing dose level. Display screen 24 of FIG. 4A may present more than one image 28, as shown in the alternate examples of FIGS. 4C and 4D. One use of a dual-image display can be to present the user simultaneously with a reference and simulated low dose image, or simultaneously with a fully rendered and unrendered simulated image, for example. Alternate use of a multi-image display can be to present the viewer with numerous examples of images at a simulated low dose exposure level, for example.

In one embodiment, non-image information, such as patient information, image identifier, original acquisition settings, image rendering settings, image toggle capability, original and simulated image information and input window, image assessment window, and prior ratings data, is hidden from the user or is minimized to an icon until needed by the user. In one embodiment, for example, the rendering window is hidden until the user clicks on an icon, presses a mouse key, or pushes a keyboard key that subsequently launches a window that displays the rendering settings and allows modification. This configuration allows more on-screen area to be dedicated for viewing the image itself.

Ratings from one or more viewers are collected and stored for analysis. The analysis includes an optimization step that results in a recommendation of dose reduction. Some optimization options include the use of extrapolations as well as optimization techniques such as Bayesian Optimization or Response Surface Analysis (RSA).

Output Instructions

Referring back to the embodiment of FIG. 2C, output instructions (shown under tab 72) include the content and location of the output and a list of ancillary actions. Selectable output content in this embodiment may include actual images, such as the reference image(s), basis image, and simulated images, or may be a subset of images, such as those that were rated as acceptable, and may have rendering applied. Output may also include rating results for each image, and may include the exposure recommendations of the viewing practitioner. Exposure recommendations may be provided to a digital file for retrieval, such as to a database, for example. Stored recommendations can be indexed for retrievability according to relevant criteria, such as one or more of exposure conditions, purpose of the exam, patient demographics, exam date, and patient history, for example.

Hardcopy (printed) output can be particularly useful as a record or guide to factors involved and results achieved. An example of output showing the exposure recommendation for a given experimental design is illustrated as an output report 74, shown in outline form in FIG. 5A. FIG. 5B through 5F then show individual fields that are part of output report 74 in this exemplary embodiment.

Output report 74 in this embodiment includes the following:

(i) A design parameters field 62, as shown in the example of FIG. 5B. This includes the experimental design parameters such as the goal of the work, the number and types of images chosen, the simulated dose reductions, the type of evaluator, and the optimization method, for example.

(ii) A ratings field 64 as shown in the example of FIG. 5C. Here, a table gives average ratings and standard deviations obtained from multiple viewing practitioners who have assessed the simulations of multiple images binned by weight categories.

(iii) A definitions field 66 that defines the rating scale employed by evaluators, as shown in tabular form in the example of FIG. 5D.

(iv) A results listing 68 as shown in the example of FIG. 5E. This includes the prediction equation from the RSA, predicted values, mean and confidence interval results for actual ratings, and a recommendation, for example.

Figure 5A:
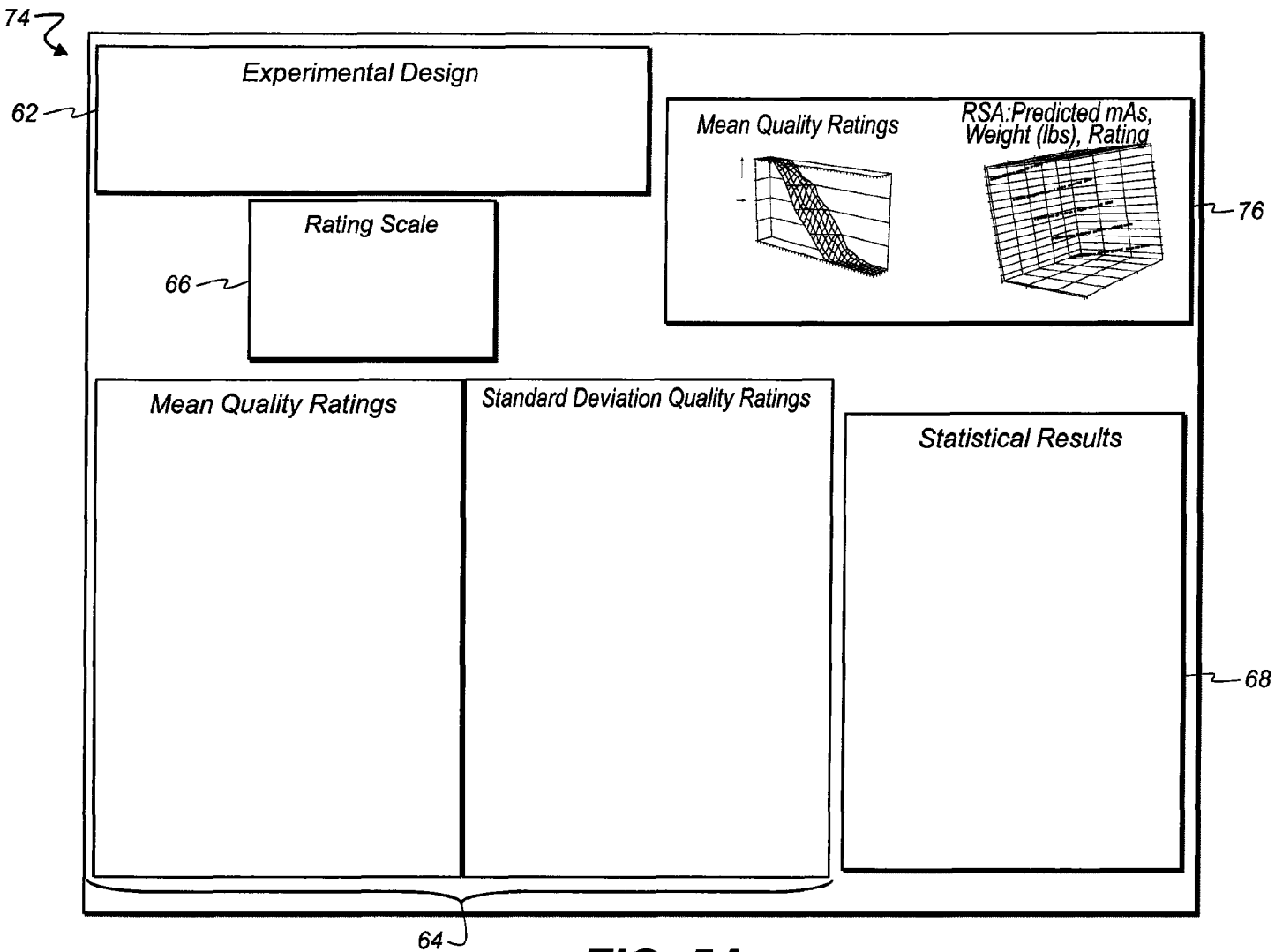
FIG. 5A shows an arrangement of fields in an output report for the dose-reduction system of one embodiment.
Figure 5F:
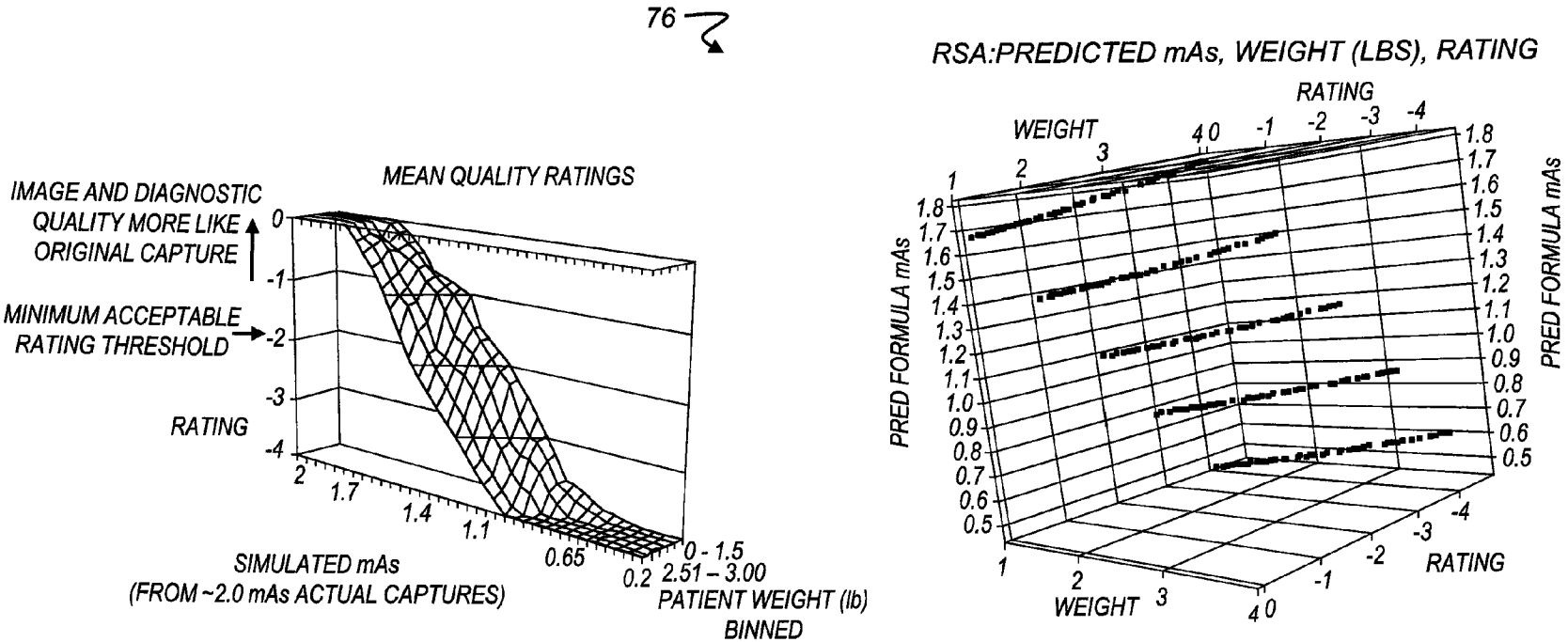

(v) Plots of ratings and predicted surface values 76 as shown in the example of FIG. 5F.

For the particular example of FIGS. 5A-5F, the experimental design outlines the goal of defining an exposure recommendation range for pediatric patients who weigh less than 4.0 lbs at the time of examination and who have been diagnosed with pneumothorax. In an example study, 60 images of 40 Neonatal Intensive Care Unit (NICU) patients were viewed. All images were acquired at one imaging site at 60 kVp, 2 mAs, and using a 40-inch source-image distance (SID). For each image, a set of simulations were generated for various exposure levels, from clinical level dosage conventionally used down to 10% of the clinical level, from approximately 2.0 mAs to 0.2 mAs in 0.05 mAs increments. The evaluators consisted of five pediatric radiologists and optimization was defined using a two-level response surface analysis (RSA) combined with a statistical analysis of the mean, standard deviation, and 95% confidence interval using a minimum acceptable rating threshold of −2.0. This relatively simple example requires two independent variables or factors, namely, patient weight and mAs, with a dependent variable of Rating. Other test arrangements may be more complicated and require additional factors such as various accelerating voltages (kVp), various tube currents (mA), exposure times (s), or combinations (mAs), various imaging sites, numerous pathologies, radiologist specialists, patient gender, and specific lab results. Ratings are across observers (Radiologists) and image examples, binned into weight categories, and displayed in graphical or tabular form. In this example, assuming a fully balanced design, each cell in the Rating Field represents an average and standard deviation of ten images rated by five radiologists, or 50 ratings. The average quality ratings are presented in two 3-dimensional plots of actual ratings and predicted ratings. In a more complicated analysis with more factors a different type of plot such as a series of contour plots of the various factors may be more useful. The results listing include the predicted mAs equation, the predicted mAs results for specific weights at the minimum acceptable rating threshold value of −2.0, and the mean nearest the minimum acceptable rating threshold of the data bin after accounting for confidence interval. A recommended exposure is provided based on these results, as well as the original exposure and the percent reduction.

The statistical results may be displayed in output report 74, as well as recommendation based on the results. The output page may contain a warning if the number of data points used to develop recommendations is considered to be too low, the variability is too high, or one or more recommendations are outside of a pre-defined acceptable range.

Other output instructions provided from the operator (FIG. 2C) may include the location of the output, which may be softcopy display, hardcopy output such as a printer, or a digital file. Ancillary actions may be identified such as retrieving more images under certain circumstances or generating an alert if the exposure recommendations are outside limits such as regulatory recommendations.

The method of the present invention provides a tool that can be used to determine reduced radiation dose levels that are best suited to particular equipment at a site. Equipped with such a tool, a diagnostic imaging practitioner can continually revise and update exposure settings as circumstances or pathologies permit.

The invention has been described in detail with particular reference to certain preferred embodiments thereof, but it will be understood that variations and modifications can be effected within the scope of the invention as described above, and as noted in the appended claims, by a person of ordinary skill in the art without departing from the scope of the invention. While the method of the present invention was developed to help meet the need for reduced dose in projection radiography, this same method could be applied to other modalities such as tomosynthesis, computed tomography, cone beam computed tomography, and gamma radiation imaging. Assessment of images in the method of the present invention can be performed using hard-copy printed images or using images on soft copy display.

Thus, what is provided is an apparatus and method for simulating reduced dose images to provide guidelines for lowering radiation exposure for x-ray images.

What is described is a method of obtaining recommendations for lowered radiation dose for a type of radiological image, the method executed at least in part by a computer system and comprising: obtaining at least one clinical image of at least one patient, taken under a baseline set of exposure conditions, as a basis image; obtaining processing instructions related to image simulation under one or more reduced exposure conditions; processing the basis image according to the processing instructions to generate a set of one or more simulation images, each simulation image representative of corresponding reduced exposure conditions; displaying the one or more simulation images to one or more diagnostic practitioners and obtaining an evaluation from the one or more practitioners related to quality of the one or more simulation images; and generating and electronically storing a recommended reduced exposure condition according to the practitioner evaluation.

In the method, displaying the one or more simulation images can further comprise providing a toggle capability for alternately viewing the same image content with different amounts of simulation applied. Displaying the one or more simulation images further can comprise providing a toggle capability for alternately viewing image content of the basis image and of a reference image.

In the method, processing the basis image to generate a set of one or more simulation images can comprise adding noise to the basis image. The noise can be from a statistical estimation of Poisson noise in the image or from a linear scaling of the noise power spectrum in the image.

In the method, obtaining processing instructions comprises obtaining rendering commands taken from the group consisting of tonal processing, frequency processing, and noise reduction processing. The method can further comprise issuing an alert for exposure conditions lying outside a predetermined threshold.

In the method, generating the recommended reduced exposure condition comprises providing a printed output or displayed output. In the method, the basis image and its related set of exposure conditions can be obtained from a database.

In the method, generating a recommended reduced exposure condition can comprise combining results from two or more practitioners. Processing the basis image according to the processing instructions can further comprise providing Bayesian optimization or providing response surface analysis.

In the method, the recommended reduced exposure conditions can be directed to a digital file. Displaying the one or more simulation images can further comprise providing operator controls for further modifying simulation conditions. In embodiments of the present invention, the operator can control set up simulation conditions for image rendering.

Thus, what is provided is a method for determining lowered radiation levels for various diagnostic imaging processes.

PARTS LIST

10. Definition step
12. Tab
14. Database
18. Image definition step
20. Support data entry step
22. Support data definition step
24. Display screen
26. Data block
28. Image
30. Simulation method definition step
32. Tab
34. Identifier
36, 38. Window
40. Rendering method specification step
42. Area
44. Cursor
46. Area
48. Toggle button
50. Viewing method selection step
52, 54, 56. Area
60. Optimization method selection step
62. Design parameters field
64. Ratings field
66. Definitions field
68. Results listing
70. Output definitions step
72. Tab
74. Output report
76. Plot
80. Ancillary actions specifications step
82. Basis image
84. Exposure conditions

86. Simulations
88. Exposure conditions
92. Practitioner
90. Generation step
100. Rendering step
110. Display step
120. Acknowledgement step
130. Conclusion step
140. Output step
145. Ancillary actions step
150. Obtain basis image step
160. Operator input step
170. Simulations generation step
180. Evaluations step
190. Recommendations generation step

The invention claimed is:

1. A method of obtaining at least one recommended reduced exposure condition for a type of radiological image, the method being executed at least in part by a computer system and comprising:

obtaining digital image data for at least one clinical image of at least one patient, taken under a baseline set of exposure conditions, as a basis image;

obtaining from one or more diagnostic practitioners processing instructions related to image simulation under one or more reduced exposure conditions;

processing the basis image according to the processing instructions to generate a set of one or more simulation images, each simulation image representative of corresponding reduced exposure conditions;

displaying the one or more simulation images to the one or more diagnostic practitioners;

obtaining and electronically storing an evaluation from the one or more diagnostic practitioners related to at least the quality of the one or more simulation images; and generating and electronically storing at least one recommended reduced exposure condition for the type of radiological image according to the evaluation from the one or more diagnostic practitioners.

2. The method of claim 1 wherein the step of obtaining the basis image is executed according to one or more of exposure conditions, purpose of the exam, patient demographics, exam date, and patient history.

3. The method of claim 1 wherein displaying the one or more simulation images further comprises providing a toggle capability for alternately displaying the same image content with different amounts of simulation applied.

4. The method of claim 1 wherein displaying the one or more simulation images further comprises providing a toggle capability for alternately displaying image content of the basis image and a reference image.

5. The method of claim 1 wherein processing the basis image comprises adding noise to the basis image.

6. The method of claim 1 wherein obtaining processing instructions comprises obtaining rendering commands taken from the group consisting of tonal processing, frequency processing, and noise reduction processing.

7. The method of claim 1 further comprising issuing an alert for exposure conditions lying outside a predetermined threshold.

8. The method of claim 1 wherein generating the at least one recommended reduced exposure condition comprises providing a printed output.

9. The method of claim 1 wherein generating the at least one recommended reduced exposure condition comprises providing displayed output.

10. The method of claim 1 wherein the basis image and its related set of exposure conditions are obtained from a database.

11. The method of claim 1 wherein generating the at least one recommended reduced exposure condition comprises combining results from two or more practitioners.

12. The method of claim 1 wherein processing the basis image according to the processing instructions further comprises providing Bayesian optimization.

13. The method of claim 1 wherein processing the basis image according to the processing instructions further comprises providing response surface analysis.

14. The method of claim 1 wherein the recommended reduced exposure conditions are directed to a digital file.

15. The method of claim 14 wherein the recommended reduced exposure conditions are directed to the digital file for retrieval, indexed according to one or more of exposure conditions, purpose of the exam, patient demographics, exam date, and patient history.

16. The method of claim 1 wherein displaying the one or more simulation images further comprises providing operator controls for further modifying simulation conditions.

17. The method of claim 1 wherein obtaining processing instructions comprises obtaining exposure recommendations related to patient demographics.

* * * * *